US005255519A

United States Patent [19]

Kakovitch

[11] Patent Number: 5,255,519

[45] Date of Patent: Oct. 26, 1993

[54] METHOD AND APPARATUS FOR INCREASING EFFICIENCY AND PRODUCTIVITY IN A POWER GENERATION CYCLE

[75] Inventor: Thomas Kakovitch, Herndon, Va.

[73] Assignee: Millennium Technologies, Inc., Reston, Va.

[21] Appl. No.: 929,433

[22] Filed: Aug. 14, 1992

[51] Int. Cl.[5] ..... F01K 21/04

[52] U.S. Cl. ..... 60/649; 60/670

[58] Field of Search ..... 60/649, 670

[56] References Cited

U.S. PATENT DOCUMENTS

| | | | |
|---|---|---|---|
| 709,115 | 9/1902 | Rosenthal . | |
| 848,027 | 3/1907 | Goodspeed et al. . | |
| 4,106,294 | 8/1978 | Czaja | 60/649 |
| 4,196,594 | 4/1980 | Abom . | |
| 4,387,576 | 6/1983 | Bissell . | |
| 4,422,297 | 12/1983 | Rojey . | |
| 4,439,988 | 4/1984 | Minardi et al. | 60/649 |
| 4,729,226 | 3/1988 | Rosado . | |
| 4,779,424 | 10/1988 | Sumitomo et al. . | |
| 4,838,027 | 6/1989 | Rosado et al. . | |
| 4,876,855 | 10/1989 | Yogev et al. . | |

*Primary Examiner*—Allen M. Ostrager

*Attorney, Agent, or Firm*—Dennison, Meserole, Pollack & Scheiner

[57] ABSTRACT

A method and apparatus for converting heat energy to mechanical energy with greater efficiency. According to the method, heat energy is applied to a working fluid in a reservoir sufficient to convert the working fluid to a vapor and the working fluid is passed in vapor form to means such as a generator for converting the energy therein to mechanical work. The working fluid is then recycled to the reservoir. In order to increase the efficiency of this process, a gas having a molecular weight no greater than the approximate molecular weight of the working fluid is added to the working fluid in the reservoir and separated from the working fluid downstream from the reservoir.

15 Claims, 10 Drawing Sheets

P
V
T
S
THE IDEAL REGENERATIVE CYCLE

P
T=CONSTANT
T=CONSTANT
V
T
P=CONSTANT
P=CONSTANT
S
ERICSSON CYCLE

P
V
T
P=CONSTANT

V=CONSTANT
S
DIESEL CYCLE
P

S=CONSTANT
S=CONSTANT
V

T
V=CONSTANT
P=CONSTANT
S
THE AIR-STANDARD ATKINSON CYCLE
P

V
RANKINE CYCLE
BOILER PRESSURE
T
CONDENSER PRESSURE
S

METHOD AND APPARATUS FOR INCREASING EFFICIENCY AND PRODUCTIVITY IN A POWER GENERATION CYCLE

BACKGROUND OF THE INVENTION

The invention relates to the field of converting heat energy to mechanical energy utilizing a working fluid, particularly for, but not necessarily limited to generating electricity.

In order to perform useful work, energy must be changed in form, i.e., from potential to kinetic, heat to mechanical, mechanical to electrical, electrical to mechanical, etc. The experimentally demonstrated equivalence of all forms of energy led to the generalization of the first law of thermodynamics, that energy cannot be created or destroyed, but is always conserved in one form or another. Thus, in transforming energy from one form to another, one seeks to increase the efficiency of the process to maximize the production of the desired form of energy, while minimizing energy losses in other forms.

Mechanical, electrical and kinetic energy are energy forms which can be transformed into each other with a very high degree of efficiency. This is not the case, however, for heat energy; if we try to transform heat energy at a temperature T into mechanical work, the efficiency of the process is limited to $1-T_0/T$, in which $T_0$ is the ambient temperature. This useful energy which can be transformed is called exergy, while the forms of energy which cannot be transformed into exergy are called anergy. Accordingly, the first law of thermodynamics can be restated that the sum of exergy and anergy is always constant.

Moreover, the second law of thermodynamics which states that processes proceed in a certain defined direction and not in the reverse direction, can be restated that it is impossible to transform anergy into exergy.

Thermodynamic processes may be divided into the irreversible and the reversible. In irreversible processes, the work done is zero, exergy being transformed into anergy. In reversible processes, the greatest possible work is done.

Energy conversion efforts are based upon the second law, to make the maximum use of exergy before it is transformed into anergy, a form of energy which can no longer be used. In other words, conditions must be created to maintain the reversibility of processes as long as possible.

The present invention is concerned with the conversion of heat energy to mechanical energy, particularly for the generation of electrical power, the process which presents the greatest problems with regard to efficiency. In the processes, heat is transferred to a working fluid which undergoes a series of temperature, pressure and volume variations in a reversible cycle. The ideal regenerative cycle is known as the Carnot cycle, but a number of other conventional cycles may be used, especially the Rankine cycle, but also including the Atkinson cycle, the Ericsson cycle, the Brayton cycle, the Diesel cycle and the Lenoir cycle. Utilizing any of these cycles, a working fluid in gaseous form is passed to a device for converting the energy of the working fluid to mechanical energy, which devices include turbines as well as a wide variety of other types of heat engines. In each case, as the working fluid does useful mechanical work, the volume of the fluid increases and its temperature and pressure decrease. The remainder of the cycle is concerned with increasing the temperature and pressure of the working fluid so that it may perform further useful mechanical work. FIGS. 1A-1J give P-V and T-S diagrams for a number of typical cycles.

Since the working fluid is an important part of the cycle for doing useful work, a number of processes are known in which working fluid is modified in order to increase the work that can be obtained from the process. For example, U.S. Pat. No. 4,439,988 discloses a Rankine cycle utilizing an ejector for injecting gaseous working fluid into a turbine. By utilizing the ejector to inject a light gas into the working fluid, after the working fluid has been heated and vaporized the turbine was found to extract the available energy with a smaller pressure drop than would be required with only a primary working fluid and there is a substantial drop in temperature of the working fluid, enabling operation of the turbine in a low temperature environment. The light gas which is used can be hydrogen, helium, nitrogen, air, water vapor or an organic compound having a molecular weight less than the working fluid.

U.S. Pat. No. 4,196,594 discloses the injection of a rare gas, such as argon or helium, into a gaseous working fluid such as aqueous steam used to carry out mechanical work in a heat engine. The vapor added has a lower H value than the working fluid, the H value being $C_p/C_v$, $C_p$ being specific heat at constant pressure and $C_v$ being specific heat at constant volume.

U.S. Pat. No. 4,876,855 discloses a working fluid for a Rankine cycle power plant comprising a polar compound and a non-polar compound, the polar compound having a molecular weight smaller than the molecular weight of the non-polar compound.

In considering the conversion of heat energy to mechanical energy, an extremely important thermodynamic property is enthalpy. Enthalpy is the sum of the internal energy and the product of pressure and volume, $H=U+PV$. Enthalpy per unit mass is the sum of the internal energy and the product of the pressure and specific volume, $h=u+Pv$. As pressure approaches zero, all gases approach the ideal gas and the change of the internal energy is the product of the specific heat, $C_{p0}$ and the change of temperature dT. The change of "ideal" enthalpy is the product of $C_{p0}$ and the change of temperature, $dh=C_{p0}dT$. When pressure is above zero, the change of enthalpy represents the "actual" enthalpy.

The difference between the ideal enthalpy and the actual enthalpy divided by the critical temperature of the working fluid is known as residual enthalpy.

Applicant has theorized that greater efficiency from a reversible process is feasible if one can increase the change in actual enthalpy of a system, within the range of temperature and pressure conditions as required by its previous design. This could conceivably be accomplished by methods which would result in the release of "residual" enthalpy, in effect, slowing down the loss of exergy in the system.

Another extremely important property of a working fluid is the compressibility factor Z, which relates the behavior of a real gas to the behavior of an ideal gas. The behavior of an ideal gas under varying conditions of pressure (P), volume (V) and temperature (T), is given by the equation of state:

$$PV=nMRT$$

where n is the number of moles of gas, M is the molecular weight, and R is $\bar{R}/M$, where $\bar{R}$ is a constant. This equation does not actually describe the behavior of real gases, where it has been found that:

$$PV = ZnMRT \text{ or } Pv = ZRT$$

where Z is the compressibility factor, and v is specific volume $$\frac{V}{nM}.$$

For an ideal gas Z equals 1, and for a real gas, the compressibility factor varies depending upon pressure and temperature. While the compressibility factors for various gases appear to be different, it has been found that compressibility factors are substantially constant when they are determined as functions of the same reduced temperature and the same reduced pressure. Reduced temperature is T/Tc, the ratio of temperature to critical temperature and reduced pressure is P/Pc, the ratio of pressure to critical pressure. The critical temperature and pressure are the temperature and pressure at which the meniscus between the liquid and gaseous phases of the substance disappears, and the substance forms a single, continuous, fluid phase.

Applicant has also theorized that a greater volumetric expansion could be obtained by modifying the compressibility factor of a working fluid.

Applicant has further theorized that substance could be found which would increase both the enthalpy and compressibility of a working fluid.

SUMMARY OF THE INVENTION

Thus, it is the object of the invention to release the residual enthalpy of a system in order to increase the efficiency of the conversion of heat energy to mechanical energy.

It is a further object of the invention to increase the expansion of a working fluid to increase the work done by the working fluid.

In order to achieve this and other objects, the invention relates to a process for converting heat energy to mechanical energy in which heat energy is applied to a working fluid in a reservoir in order to convert the fluid from liquid to vapor form, and passing the working fluid in vapor form to a means for converting the energy therein to mechanical work, with increased expansion and reduction in temperature of the working fluid, and recycling the expanded, temperature reduced working fluid to the reservoir.

Applicant has discovered that the efficiency of this process may be increased by adding a gas to the working fluid in the reservoir, the gas having a molecular weight no greater than the approximate molecular weight of the working fluid, such that the molecular weight of the working fluid and gas is not significantly greater than the approximate molecular weight of the working fluid alone. The gas is subsequently separated from the working fluid external to the reservoir and recycled to the working fluid in the reservoir.

Where the working fluid is water, the preferred gases for use in this process are hydrogen and helium. While hydrogen holds a slight advantage in terms of efficiency it is relatively disadvantageous in terms of safety in some situations, and helium is therefore preferred in practical applications.

The practical effect of adding the gas to the working fluid in the reservoir is to substantially increase the change in enthalpy, and thus the expansion which the fluid undergoes at a given heat and pressure. In view of this greater expansion, a greater amount of mechanical work can be done for a fixed amount of heat energy input, or the amount of heat energy can be reduced in order to obtain a fixed amount of work. In either case, there is a considerable increase in the efficiency of the process.

DESCRIPTION OF THE PREFERRED EMBODIMENTS

In conceiving the present invention, Applicant theorized that when a working fluid is heated in a reservoir, the change in actual enthalpy over a given temperature range is greater when a "catalytic" substance is added to the working fluid. In such cases, there would be more heat available to do work when the catalytic substances are present, and there would be an increase in pressure at any given temperature as compared with the same system without the catalyst. There could be a reduction in temperature for any given pressure as compared with the same system without the catalyst.

Applicant theorized that by combining steam with a small amount, i.e. 5% by weight, of a "catalytic" gas, the compressibility factor of the resultant gas would undergo a considerable change. The computed compressibility factors Z for combinations of steam and a number of gases are shown in FIG. 2. Over the given reduced pressure range shown in FIG. 2, which is 0.1 to greater than 10, steam alone has the smallest Z. The factor Z can be increased by adding various proportions of gases, although the change from adding the heaviest gases, Xe, Kr and Ar is relatively small. However, when one adds hydrogen or helium to the steam, the change in compressibility factor is rather dramatic. An expansion of this graph over the central part of the range is shown in FIG. 3. It can be seen from FIG. 3 that when operating in the reduced pressure range of greater than 1 but less than about 1.5, adding 5% helium to the steam increases the compressibility factor by about 50%. Adding hydrogen to the steam over this range increases the compressibility factor by approximately 80%. In effect adding a small amount of catalytic substance to the steam results in the steam acting much closer to an ideal gas, and can provide a substantial increase in available energy output for a given temperature range.

This increase in Z can also be viewed in FIG. 4, a computer generated graph, in three dimensions, as a function of both reduced pressure and reduced temperature. By operating in excess of both the critical temperature and critical pressure, the rise in Z is even more dramatic.

In the equation below, let the subscript "a" represent properties associated with steam alone, and the subscript "w" represent properties associated with steam plus a catalytic substance, for pressure, volume, molecular mass and the constant (R). By the definition of the compressibility factor we know:

$$Z_a = \frac{Pv_a}{R_a T} \tag{2}$$

and

-continued $$Z_w = \frac{Pv_w}{R_wT} \quad (3)$$

The above equations can be combined as follows:

$$\frac{Z_w}{Z_a} = \frac{Pv_w}{R_wT\frac{Pv_a}{R_aT}} \quad (4)$$

and if P and T are the same in both systems, they will drop out of the equation which will then become:

$$\frac{Z_w}{Z_a} = \frac{R_av_w}{R_wv_a} \quad (5)$$

However, we have already shown that theoretically $Z_w$ is greater than or equal to $Z_a$, and therefore:

$$\frac{R_av_w}{R_wv_a} \geqq 1 \quad (6)$$

or $$R_av_w \geqq R_wv_a \quad (7)$$

However, we also know that:

$$R_a = \frac{R}{M_a} \quad (8)$$

and $$R_w = \frac{R}{M_w} \quad (9)$$

by combining these relationships with equation 7 we obtain:

$$\frac{R}{M_a}v_w \geqq \frac{R}{M_w}v_a \quad (10)$$

or $$\frac{M_w}{M_a}v_w \geqq v_a \quad (11)$$

We also know that:

$$v_a = \frac{V_a}{m_a} \quad (12)$$

and $$v_w = \frac{V_w}{m_w} \quad (13)$$

where $V_a$ is the standard volumetric expansion of steam and $V_w$ is the volumetric expansion f steam plus a catalytic substance. We can therefore rewrite the inequality as:

$$\frac{M_w}{M_a}\ \frac{V_w}{m_w} \geqq \frac{V_a}{m_a} \quad (14)$$

or

-continued $$\frac{M_w}{M_a}\cdot\frac{1}{\frac{m_w}{m_a}}V_w \geqq V_a \quad (15)$$

In the particular system being considered, steam plus 5% by weight helium, the molecular weight ($M_a$) of water is 18 and:

$$\frac{m_w}{m_a} = 1 + 0.05 = 1.05$$

By analysis, it has been determined that $M_w$ is equal to 15.4286 and therefore:

$$\frac{15.4286}{(18)(1.05)}V_w \geqq V_a \quad (17)$$

Equation 17 reduces to the following inequality:

$$V_w \geqq 1.225\ V_a.$$

The above equations therefore show that under a given set of conditions, the volumetric expansion of a combination of steam with helium and/or hydrogen is substantially greater than the volumetric expansion of the steam alone. By increasing the volumetric expansion of the steam under given conditions, the amount of work done by the steam can be substantially increased.

This theory was proved theoretically by making the necessary enthalpy calculations for given systems. To determine the residual enthalpy of a working fluid over a particular temperature range, it is necessary to utilize a function that ties together the ideal and actual enthalpy of the system to the generalized compressibility function. The residual enthalpy can be calculated from the following equation:

$$\frac{h^* - h}{Tc} = R\int_o^P T_r^2\frac{dz}{dT_r}P_r\cdot d\ln P_r \quad (1)$$

where the left side of the equation represents the residual enthalpy as the pressure is increased from zero to a given pressure at a constant temperature.

Calculations were also made for enthalpy change for given variations of temperature and pressure. FIG. 5 shows the enthalpy change for steam alone, while FIG. 6 shows the enthalpy change for a combination of steam with 5% helium. These plots are superimposed in FIG. 7, and show a dramatic result. When 5% helium is added to the steam, the change of enthalpy is increased in every case by approximately 13 BTU per pound mass of water.

Consider the application of this principle to the actual generation of electrical power. A typical generating plant generates 659 megawatts of electricity utilizing 4,250,000 pounds of water per hour. By increasing the energy efficiency of the plant by 13 BTU per pound of water, a savings of approximately 55,000,000 BTU per hour can be realized.

The theory has been applied above to enthalpy release from steam, but is equally applicable to any and every working fluid which is heated to the gaseous state and which undergoes expansion and cooling to do mechanical work. Thus, adding to such a working fluid in the reservoir a gas of lower molecular weight will increase the amount of work done with the same heat input.

EXAMPLES

Figures 1A, 1B, 1C, 1D, 1E, 1F, 1G, 1H, 1I, 1J:
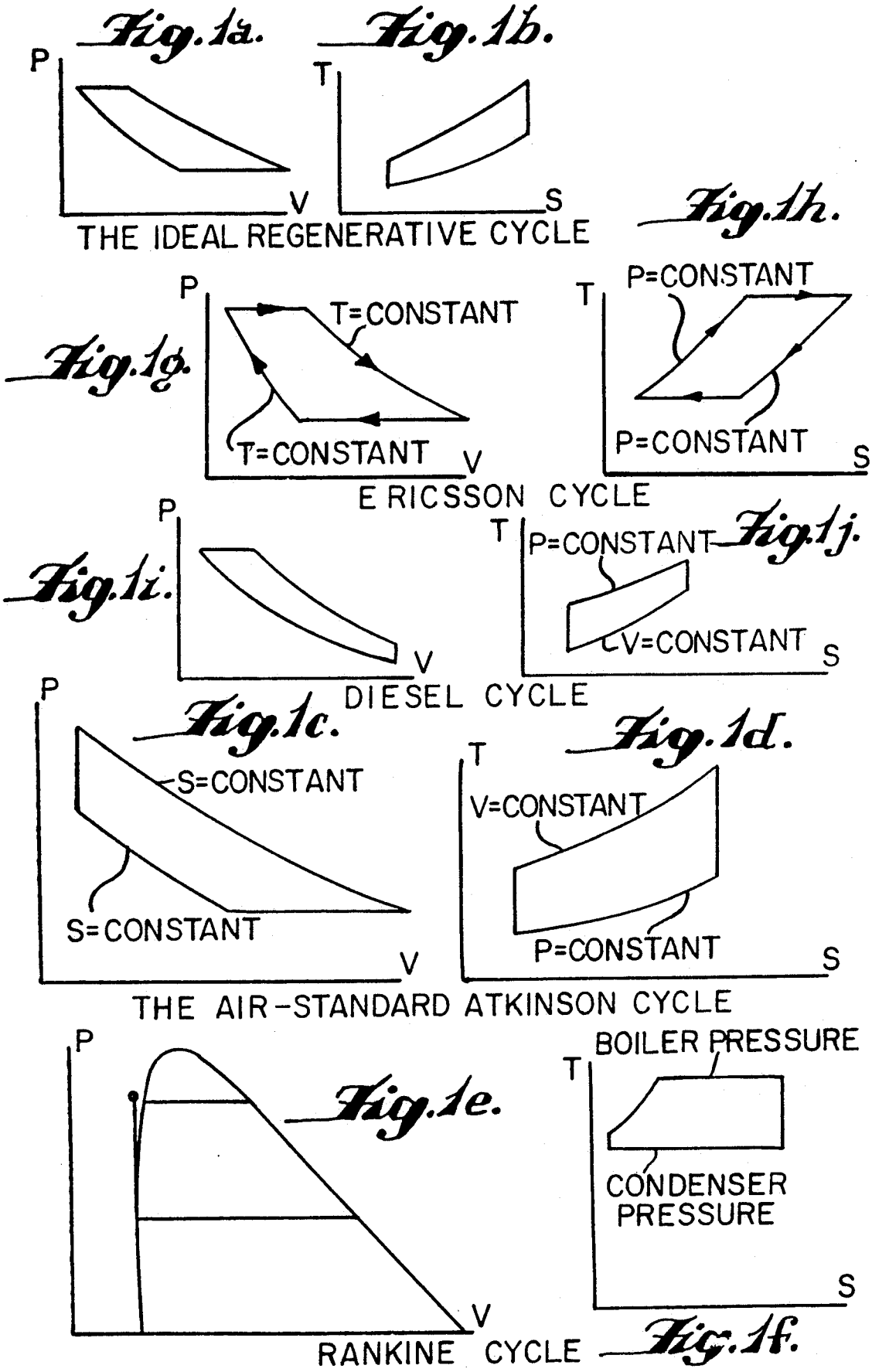
FIGS. 1A-1J show P-V and T-S graphs for a number of cycles for doing work.
Figure 2:
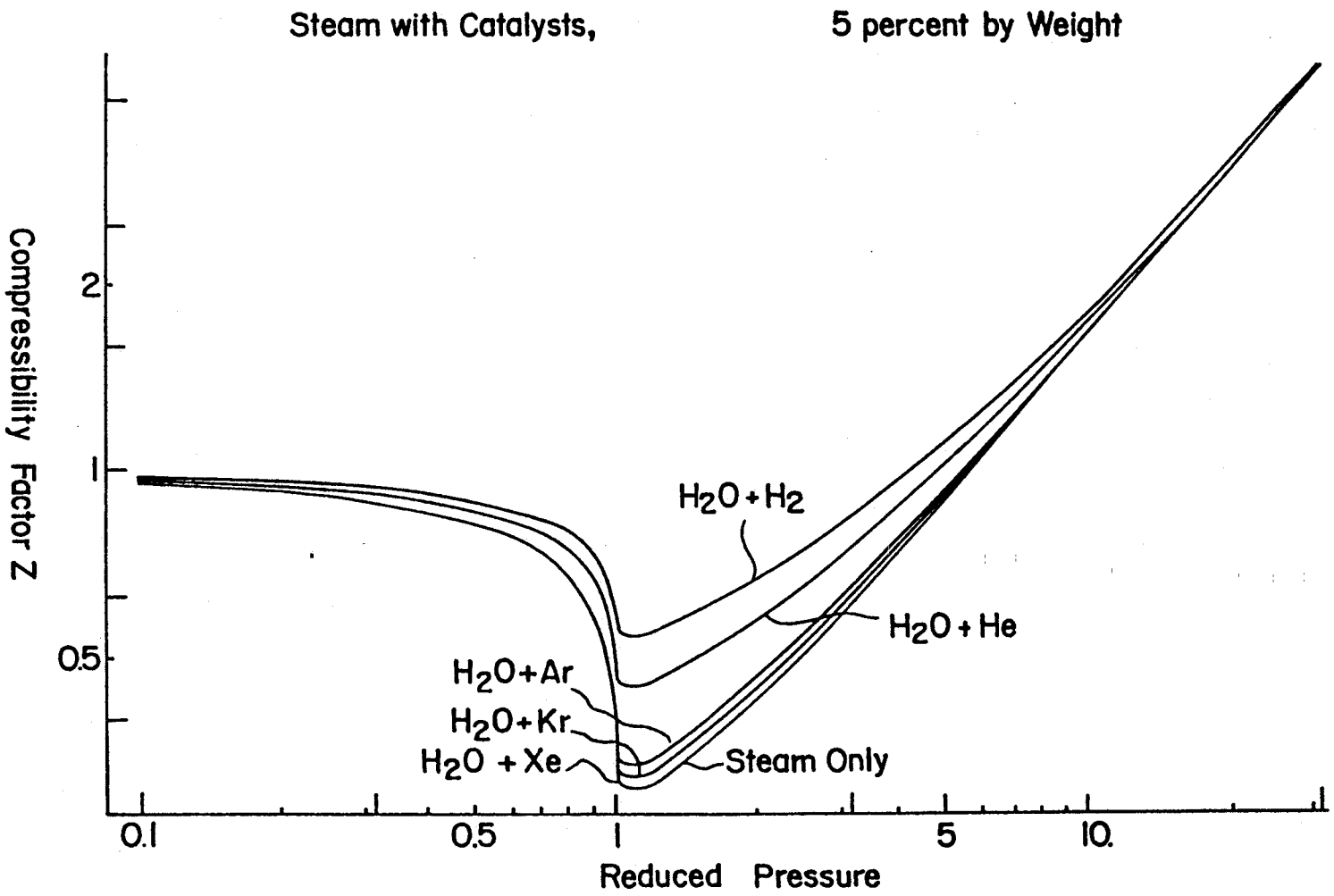
FIG. 2 is a graph of compressibility factor Z versus reduced pressure for steam alone and combinations of steam with a number of gases.
Figure 3:
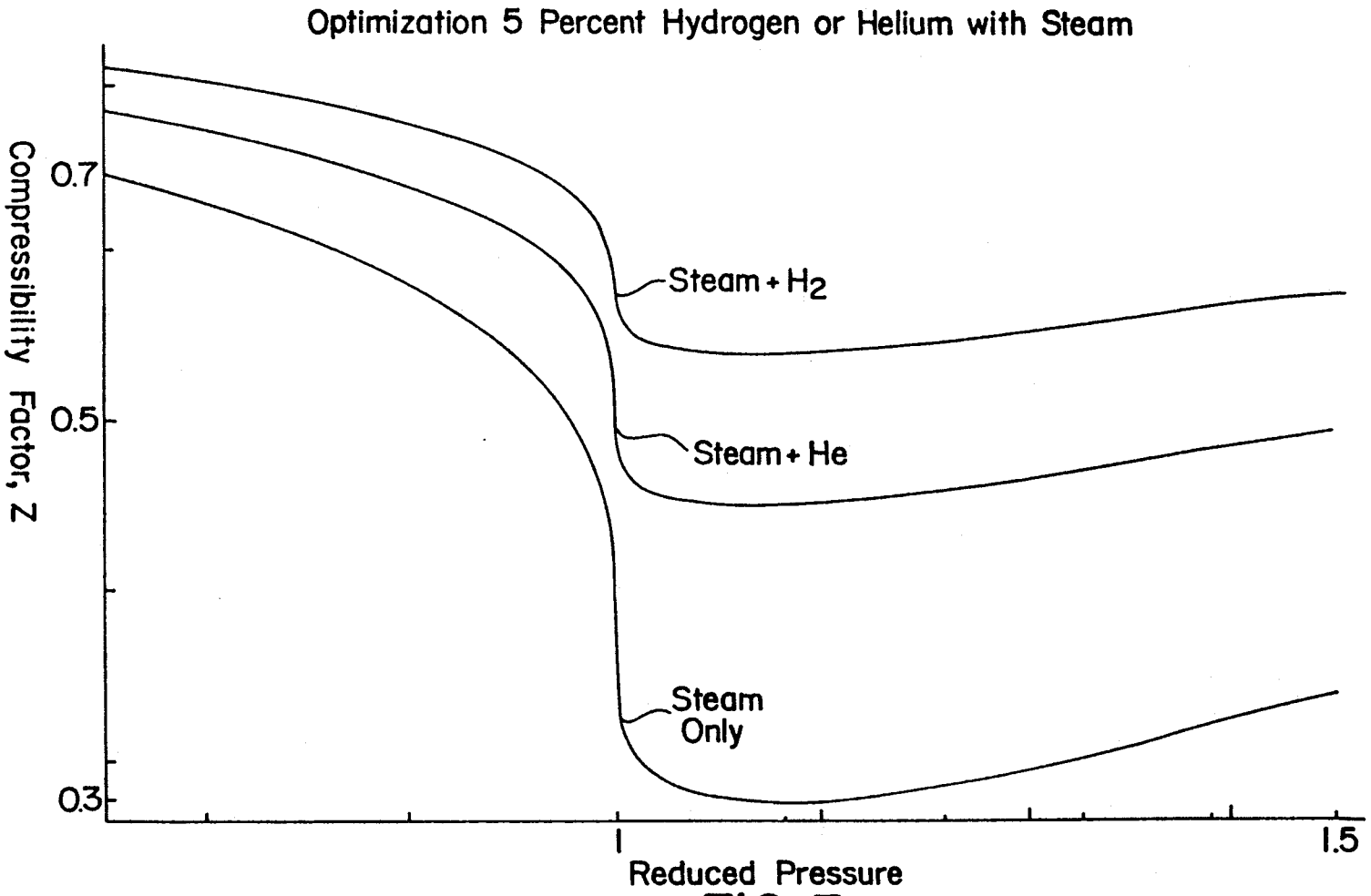
FIG. 3 is an expanded portion of the graph of FIG. 2.
Figure 4:
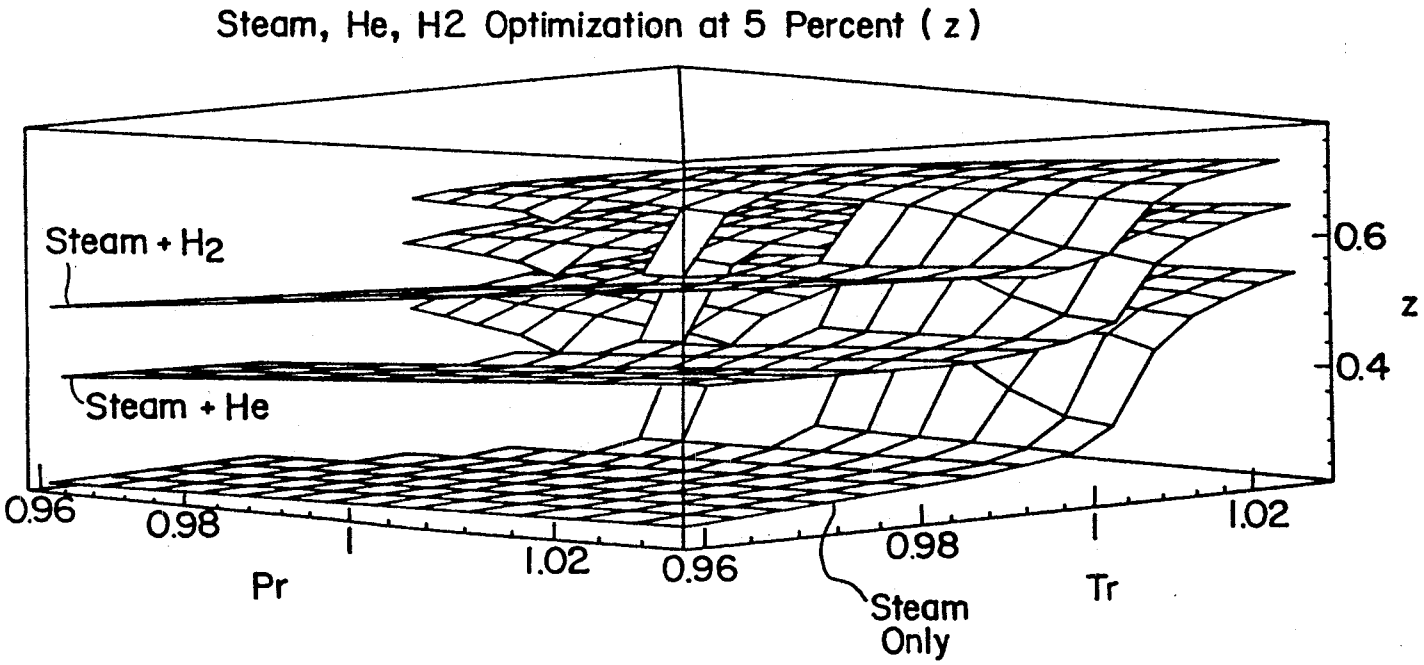
FIG. 4 is a graph of compressibility factor Z versus temperature and versus pressure for steam alone, for steam with helium and for steam with hydrogen.
Figure 5:
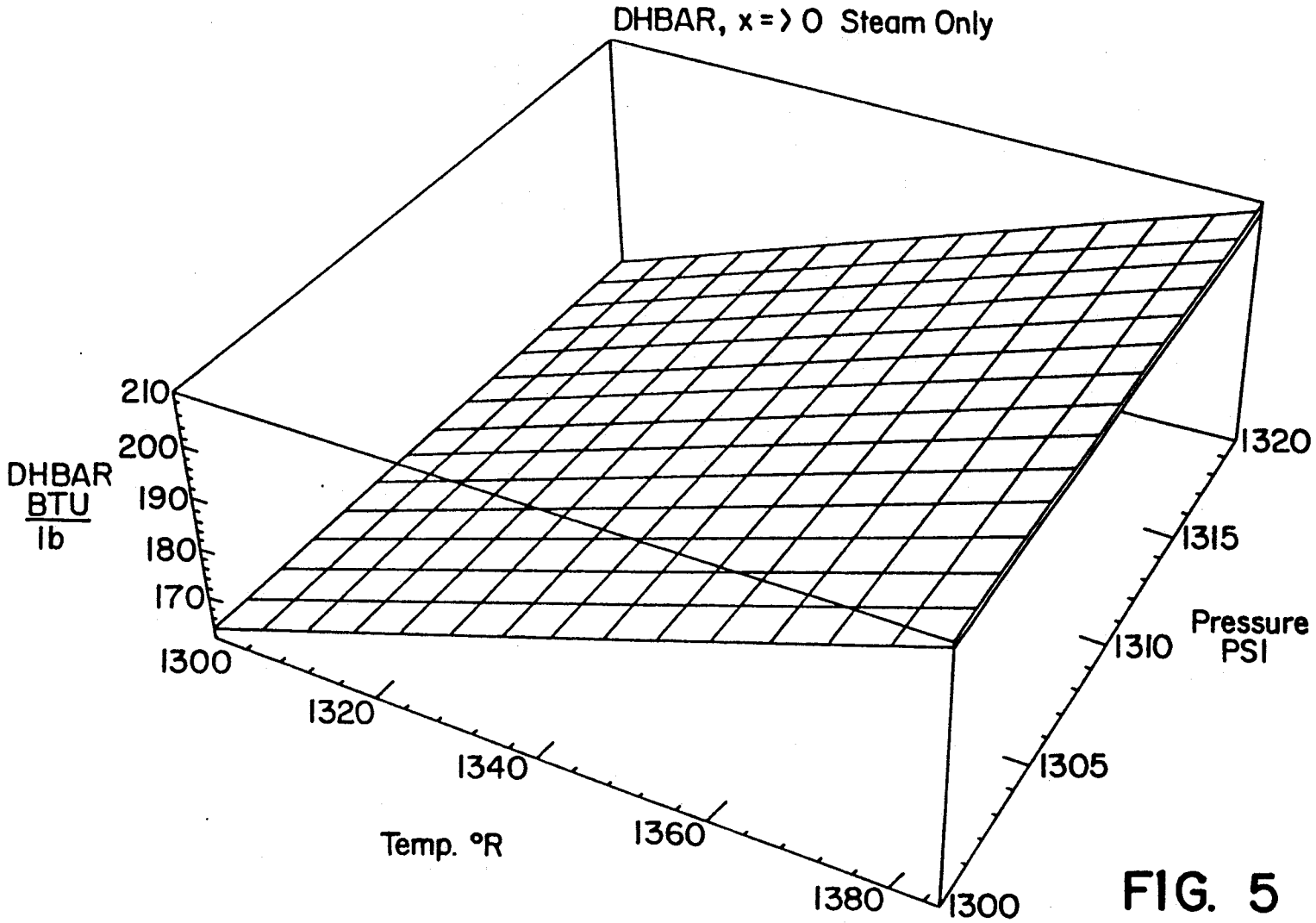
FIG. 5 is a graph of change in enthalpy versus temperature and versus pressure for steam.
Figure 6:
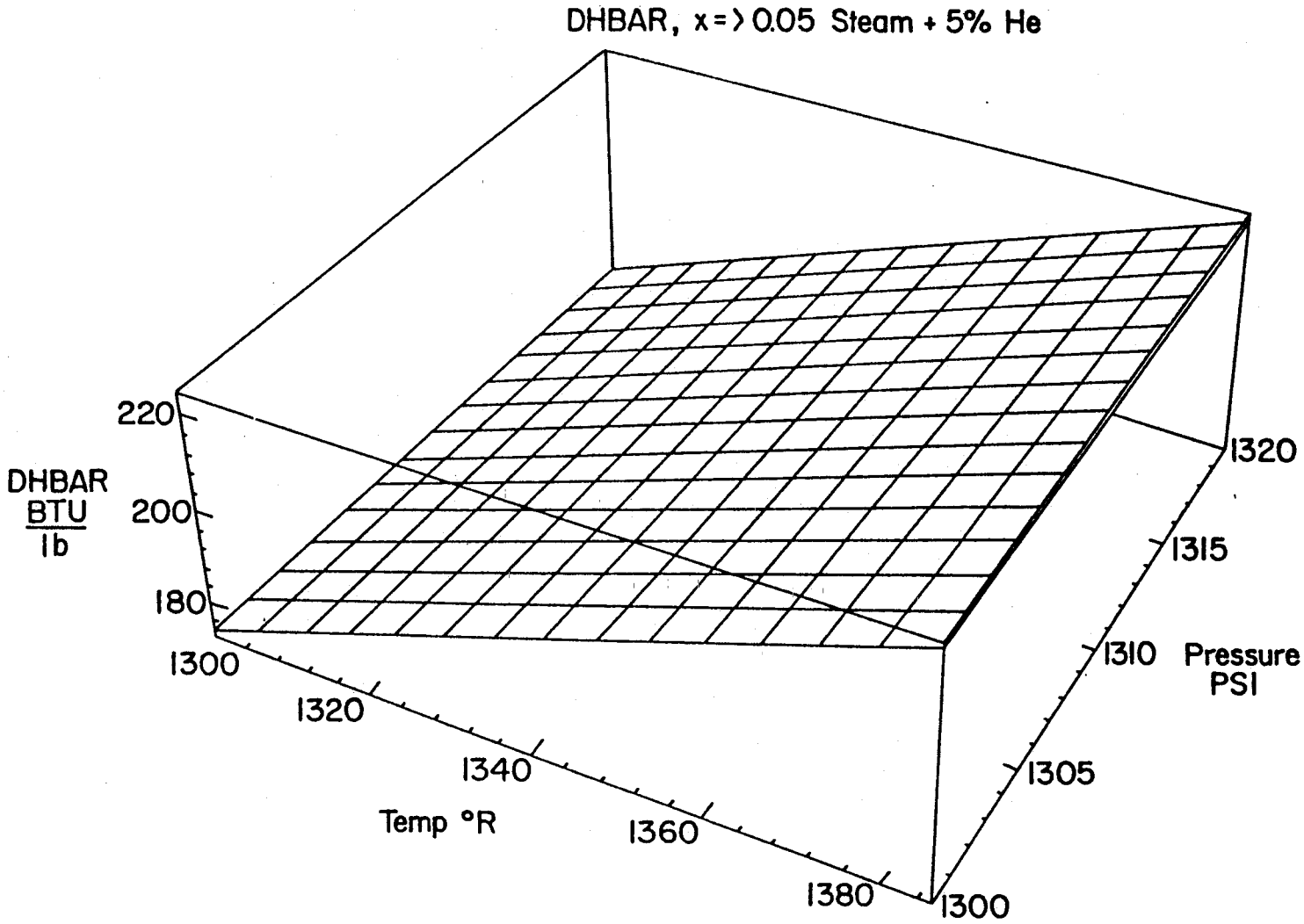
FIG. 6 is a graph of change of enthalpy versus temperature and versus pressure for steam with 5% helium.
Figure 7:
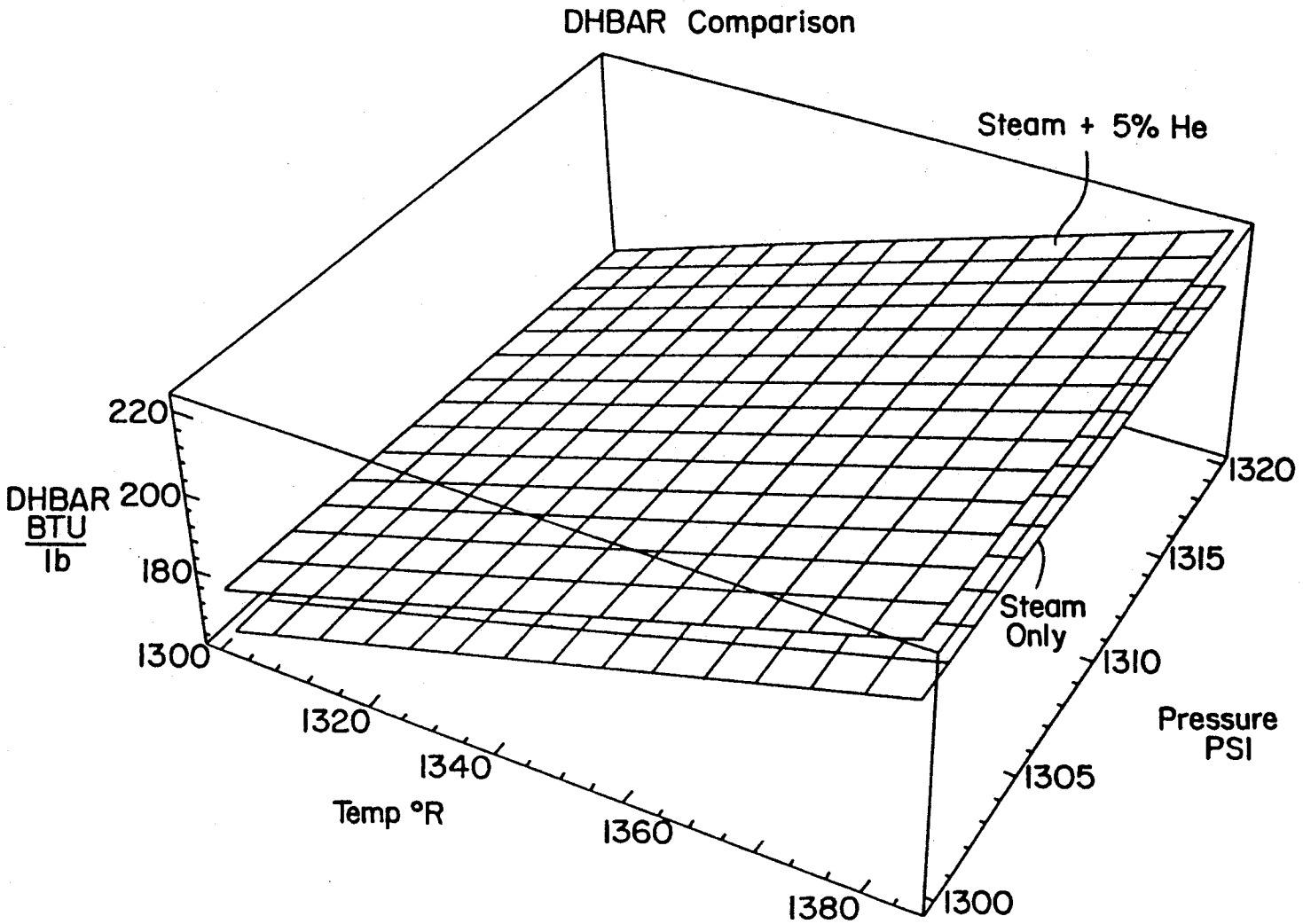
FIG. 7 is a graph of change of enthalpy versus temperature and versus pressure for both steam alone and steam with 5% helium.
Figure 8:
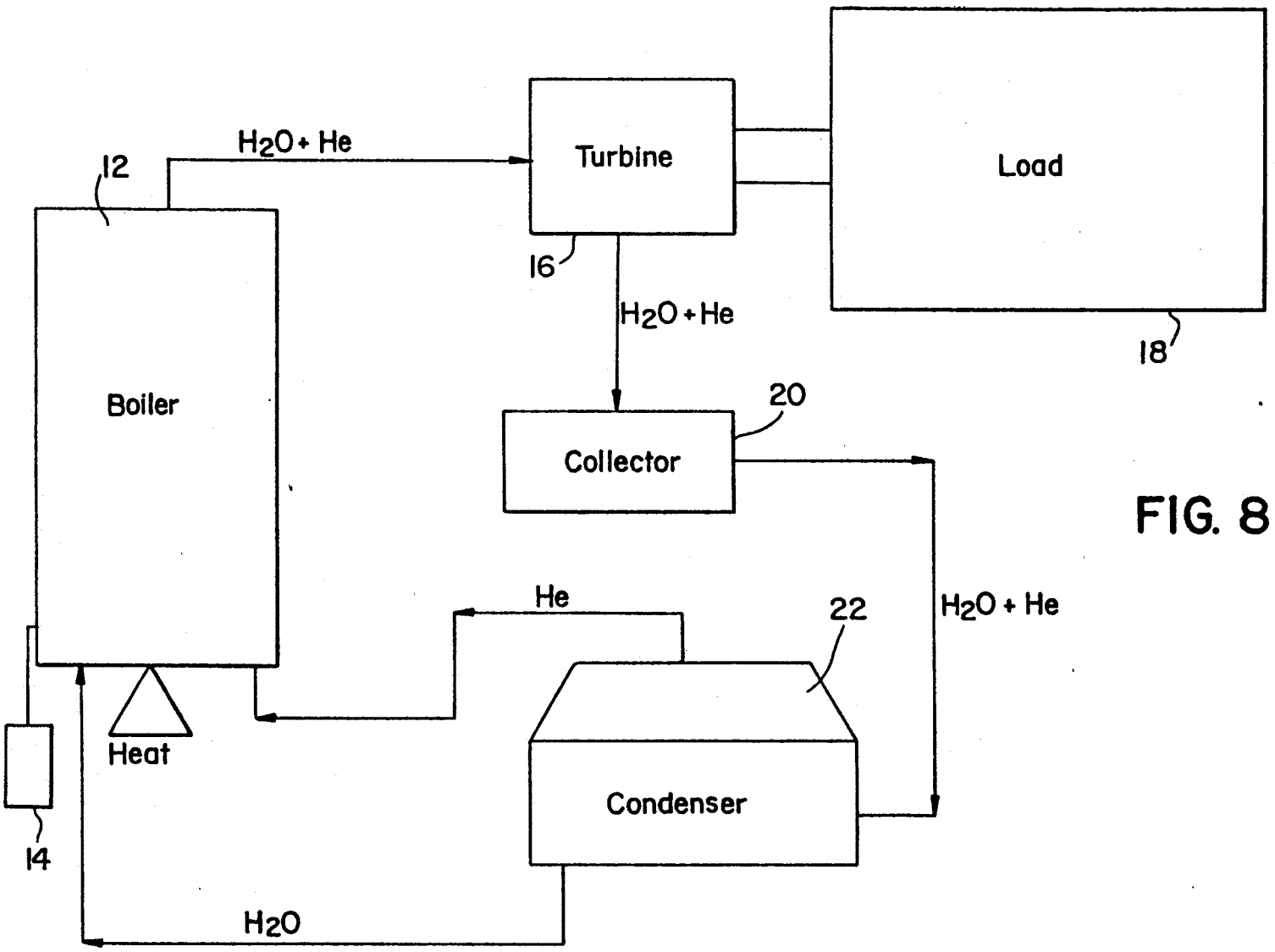
FIG. 8 is a schematic diagram of an apparatus for converting heat to mechanical energy using water as the working fluid.

An apparatus constructed as shown in FIG. 8 utilizes a boiler 12 to heat a working fluid, in this case water. A tank 14 is connected to the boiler for adding a gas to the working fluid. The output of the boiler is connected to a turbine 16 which generates electricity consumed by load 18. The working fluid which expands in turbine 16 is collected by collector 20 and condensed back to a liquid in condenser 22. Condenser 22 separates the added gas from the liquid working fluid which is then returned to the boiler. Where appropriate methodology is available, the gas may also be separated from the steam prior to the turbine.

In practice, the boiler used was a commercially available apparatus, sold under the trademark BABY GIANT, Model BG-3.3 by The Electro Steam Generator Corporation of Alexandria, Va. The boiler is heated by a stainless steel immersion heater consuming 3.3 kilowatts and developing an output of 10,015 BTUs per hour. The boiler as manufactured included temperature and pressure gauges located such that they would read the temperature and pressure in the boiler. Additional gauges were added to the system to read steam temperature and pressure, downstream in the collector. Valves were also added to the boiler allow gases to be added to the working fluid in the boiler. The temperature and pressure of the steam were measured in a 60 psi condenser coil which was added specifically to trap the steam.

The turbine was a 12 volt car alternator, having fins welded to it.

The results of the various runs are shown in Tables 1 and 2, below. The basic working fluid used was water, and water with additions of 5% helium, 5% neon, 5% oxygen and 5% xenon. Temperature and pressure readings were made at the collection coil initially, when the device was turned on, and at times of 30, 60 and 90 minutes for both the water and the steam.

TABLE 1

| | TEMPERATURE | | | | |
|---|---|---|---|---|---|
| | Steam | Steam & Helium | Steam & Neon | Steam & Oxygen | Steam & Xenon |
| Base | 70 | 65 | 70 | 70 | 70 |
| 30 Minutes | 180 | 170 | 175 | 180 | 180 |
| 60 Minutes | 266 | 245 | 257 | 262 | 266 |
| 90 Minutes | 376 | 310 | 362 | 370 | 376 |

TABLE 2

| | PRESSURE, P.S.I. | | | | |
|---|---|---|---|---|---|
| | Steam | Steam & Helium | Steam & Neon | Steam & Oxygen | Steam & Xenon |
| Base | 14.7 | 14.7 | 14.7 | 14.7 | 14.7 |
| 30 Minutes | 15.0 | 15.0 | 15.0 | 15.0 | 15.0 |
| 60 Minutes | 32.5 | 37.0 | 33.5 | 33.0 | 33.0 |
| 90 Minutes | 68.0 | 73.5 | 68.0 | 68.0 | 68.0 |

The data in Tables 1 and 2 represents averages obtained from a number of runs.

Figure 9:
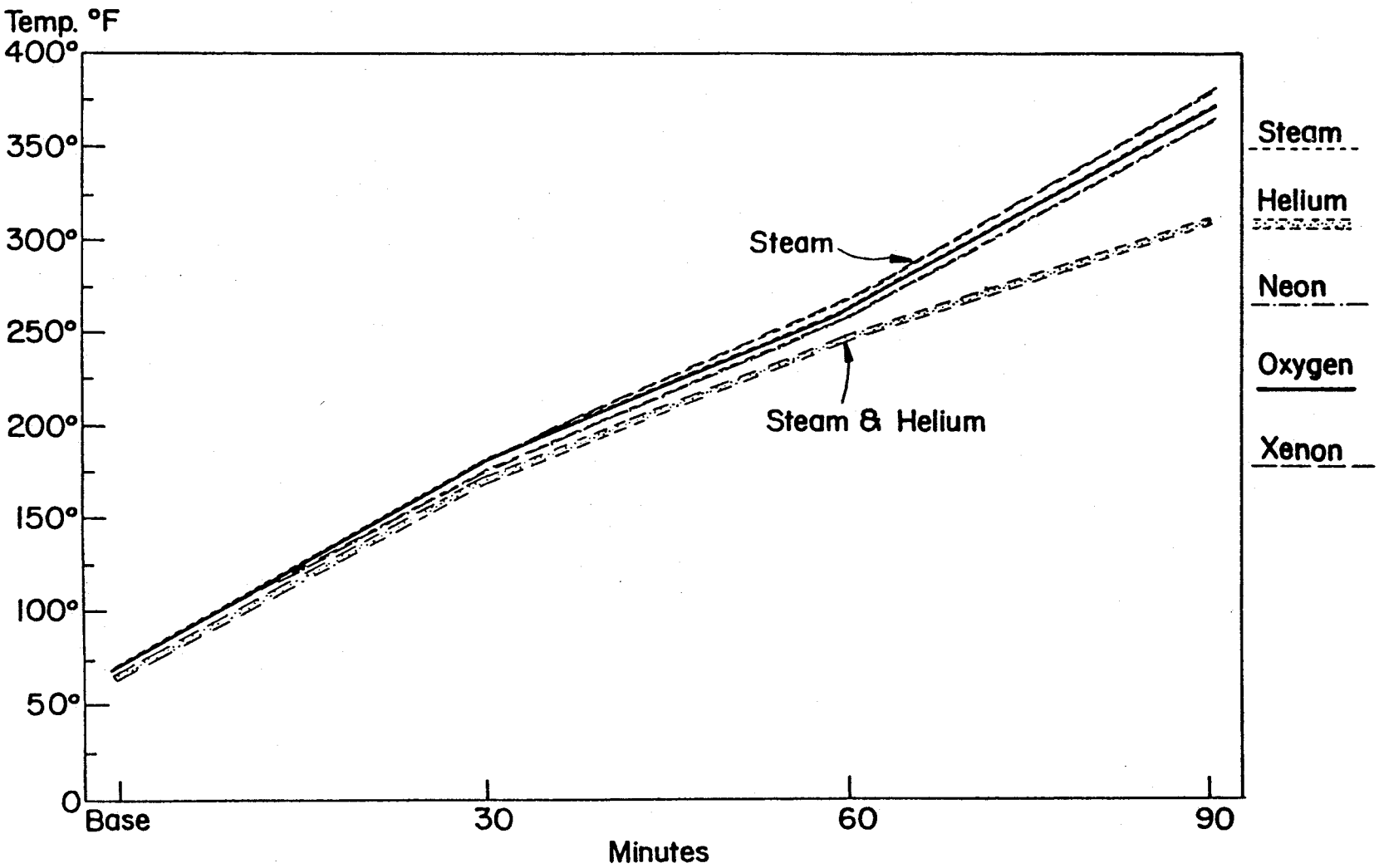
FIG. 9 is a graph of temperature versus time for various substances heated in the apparatus shown in FIG. 8.
Figure 10:
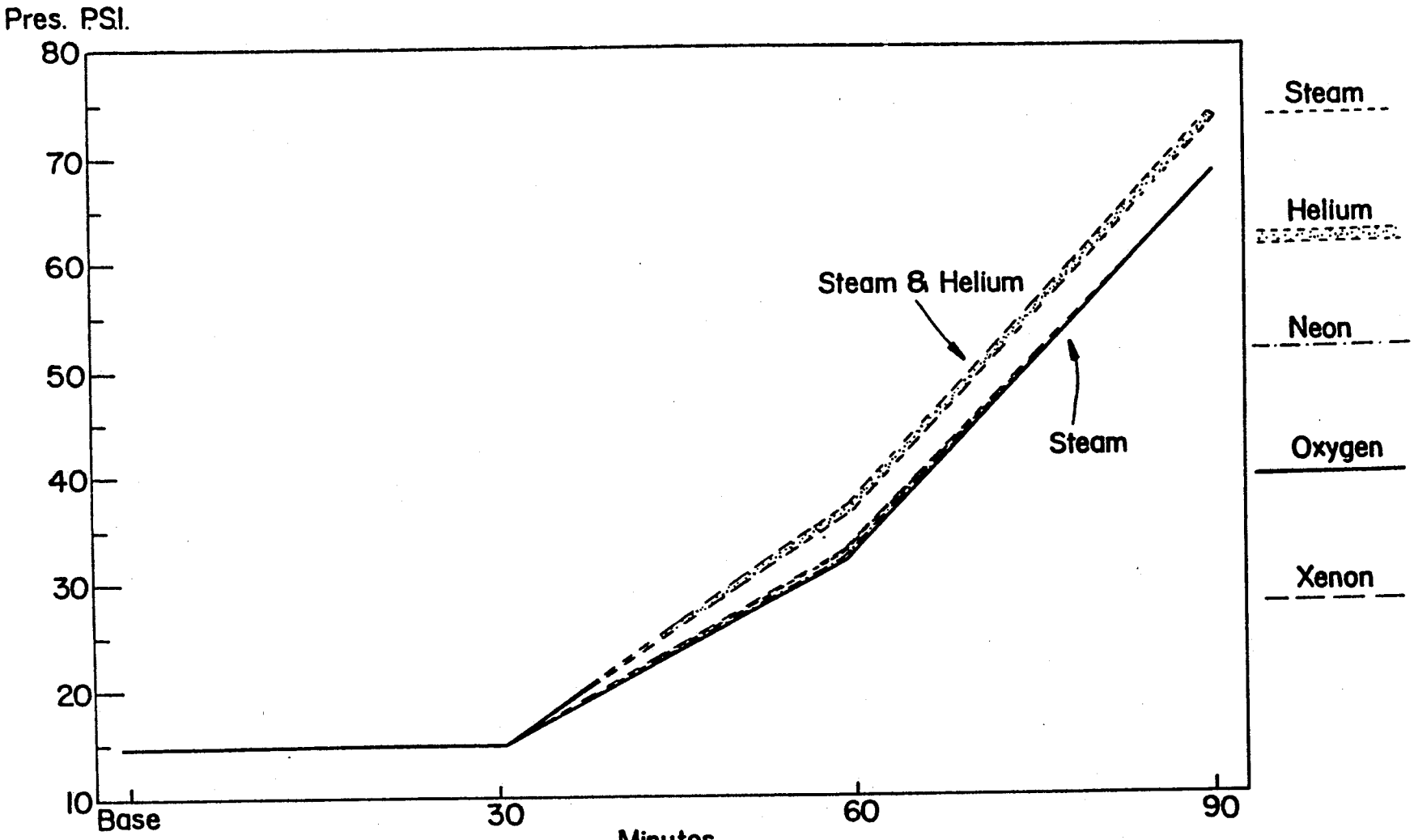
FIG. 10 is a graph of pressure versus time for various materials heated in the apparatus of FIG. 8.

The temperature data of Table 1 is plotted in FIG. 9 and the pressure data of Table 2 is plotted in FIG. 10. The results shown in these graphs are quite dramatic. After 90 minutes, the temperature of the steam plus helium combination is the lowest of all the working fluids, averaging about 310° F. The temperature of the steam plus neon combination is somewhat higher, about 362° steam plus oxygen is about 370° F., and the temperatures of steam alone, and steam with xenon are both about 376° F.

The same relationship was found generally to apply to the temperature of the water in the boiler, with the water plus helium combination being about 200° after 90 minutes, and water plus neon combination being about 215°. The other combinations were all about 230° F.

With the pressures, the opposite relationship was found to apply. The steam plus helium is at the highest pressure, about 72.5 psi. The other combinations were all at about the same pressure, the steam pressure measured being about 68 psi.

In addition, a voltmeter was connected to the alternator output. The reading for steam alone was 12 volts. For steam+He, the output was up to 18 volts.

Thus, it is clear that by adding a small amount of helium to the boiler, the resultant temperature after 90 minutes is relatively low, while the pressure obtained at the low temperature is relatively high. As a result of this higher pressure, more useful work can be done with the same amount of energy input.

The "catalytic" substance can be added to the working fluid over a wide range, for example, about 0.1 to 50% by weight. The closer the molecular weight of the working fluid, the greater the amount of "catalytic" substance that will be necessary. Where water is the working fluid, 3-9% by weight $H_2$ or He is preferred for addition.

Both hydrogen and helium increase the actual enthalpy of the working fluid, and increase the compressibility factor, increasing the expansion and enabling more mechanical work to be done. In addition, helium has been found to actually cool down the boiler, reducing fuel consumption and pollution.

The increase in enthalpy and a compressibility factor are most dramatic when operating at the critical temperature and pressure of the working fluid, for water, 374° C. and 218 atm (3205 psi). While special containers are required for operation at such high pressures, such equipment is available and used, for example, with generation of power using nuclear reactors.

What is claimed is:

1. In a process for converting heat energy to mechanical energy, comprising:

applying heat energy to a working fluid in a reservoir sufficient to convert the working fluid from liquid to vapor form;

passing the working fluid in vapor form to a means for converting energy therein to mechanical work, with expansion and reduction in temperature of the working fluid; and recycling expanded, temperature reduced working fluid in liquid form to the reservoir;

the improvement comprising adding to the working fluid in the reservoir, a gas having a molecular weight no greater than the approximate molecular weight of the working fluid; and separating the gas from the working fluid external to the reservoir after the working fluid and gas have passed through said means for converting.

2. A process according to claim 1, wherein the separated gas is recycled to the reservoir.

3. A process according to claim 1, wherein the working fluid is water.

4. A process according to claim 3, wherein the gas is hydrogen or helium.

5. A process according to claim 1, wherein the gas is added to the working fluid in an amount of about 0.1-9% by weight.

6. A process according to claim 5, wherein the gas is added in an amount of about 3-9% by weight.

7. A process according to claim 1, wherein the reservoir is a boiler.

8. A process according to claim 1, wherein the working fluid is passed to said means for converting at a temperature and pressure of about the critical temperature and pressure of the working fluid.

9. A process according to claim 8, wherein the working fluid is water heated in the reservoir to about 374° C.

10. A process for increasing the enthalpy and the compressibility factor of water vapor, comprising heating water in a reservoir to form water vapor, and adding about 0.1 to 9% by weight hydrogen or helium to the water in the reservoir to form a mixture with said water vapor of increased enthalpy and compressibility factor.

11. An apparatus for converting heat energy to mechanical energy, comprising:

a) a reservoir for containing a working fluid;

b) a gas source in fluid connection with said reservoir;

c) means for heating the working fluid in said reservoir to vapor form;

d) means for expanding the working fluid in vapor form and converting a portion of the energy therein to mechanical work, in fluid connection with said reservoir;

e) means for cooling and condensing expanded working fluid in vapor form in fluid connection with said means for expanding;

f) means for returning cooled, condensed working fluid to the reservoir;

g) means for separating gas from cooled, condensed working fluid.

12. Apparatus according to claim 11, additionally comprising means for returning separated gas to the reservoir.

13. Apparatus according to claim 11, wherein said gas source contains hydrogen or helium.

14. A process according to claim 10, additionally comprising using said mixture to do work.

15. A process according to claim 10, wherein about 3 to 9% by weight hydrogen or helium is added.

* * * * *